US005672109A

United States Patent [19]

Natanian

[11] Patent Number: 5,672,109

[45] Date of Patent: Sep. 30, 1997

[54] ELECTRONIC GAME EMPLOYING VISUAL AND PRIZE DISPLAY

[76] Inventor: Arthur Natanian, 1225 E. Stanley Ave., #201, Glendale, Calif. 91206

[21] Appl. No.: 722,886

[22] Filed: Sep. 23, 1996

[51] Int. Cl.[6] ..... A63F 9/02

[52] U.S. Cl. ..... 463/52; 463/22; 463/2

[58] Field of Search ..... 463/51, 52, 2, 463/22, 53, 54; 273/371, 372, 374, 376, 377, 139, 138.2, 445, 446

[56] References Cited

U.S. PATENT DOCUMENTS

| | | | |
|---|---|---|---|
| 3,549,147 | 12/1970 | Katter | 463/52 |
| 3,960,380 | 6/1976 | Yokoi | 463/51 |
| 4,192,507 | 3/1980 | Rains et al. | 463/51 |
| 4,533,144 | 8/1985 | Juarez et al. | 463/52 |
| 5,437,463 | 8/1995 | Fromm | 463/51 |
| 5,439,230 | 8/1995 | Mendes, Jr. | 463/51 |

*Primary Examiner*—Mark S. Graham
*Attorney, Agent, or Firm*—Roger A. Marrs

[57] ABSTRACT

An electronic game is disclosed having a light responsive target operable by a light beam from a light gun that selects a number from a random sequence of numbers. Signals from the target representing the selected number are simultaneously displayed on a viewing board or screen and on a prize table having a plurality of receptacles which are occupied by a prize. The viewing board and prize table include lights that illuminate to display the selected number so that participants can see and enjoy the chance and random selection of the winning number as well as the choice of prize. The light gun and target of random numbers represents a chance determining device for the selection of prize.

6 Claims, 1 Drawing Sheet

ELECTRONIC GAME EMPLOYING VISUAL AND PRIZE DISPLAY

BACKGROUND OF THE INVENTION

1. Field of the Invention

The present invention relates to the field of electronic games, and more particularly to an electronic game having a light sensitive target responsive to a generated light beam to activate a visual display as well as to cause the display of a particular prize.

2. Brief Description of the Prior Art

In the past, it has been the conventional practice to provide a variety of electronic games which include a target that may be actuated by means of light beams, physical contact or impact of a thrown object or which may be simply embedded into the target. In other electronic devices, a visual display is selectively actuated dependent upon selections of buttons, keys or the like depressed or chosen by a player. In still other electronic games, prizes are selected by players who remotely operate claws or other mechanical devices to effect selection. Problems and difficulties have been encountered with such devices which stem largely from the fact that no combination permits the light beam actuation of a target that, in turn, displays numbers arranged in rows and columns and, further, which will simultaneously display prizes in individual receptacles arranged in rows and columns corresponding to the rows and columns of the display.

Examples of prior patents having disclosures pertaining to electronic games and amusement devices are U.S. Pat. Nos. 5,377,975; 5,377,973; 5,398,932 and 5,476,259. A video game is disclosed in U.S. Pat. No. 5,368,309. In such prior electronic devices, there is a lack of prize selection and actual distribution and there is no coordination or simultaneous indication of a selected prize or a winning number that relates to the prize.

Therefore, a long-standing need has existed to provide an electronic amusement or game apparatus which allows the winning of prizes that are numbered and are related to a particular number on a target while the particular number is visually displayed.

SUMMARY OF THE INVENTION

Accordingly, the above problems and difficulties are avoided by the present invention which provides an improved amusement game utilizing electronic equipment permitting a participant to select a given number from a random array of numbers and further including electronic display means for indicating the number and additional means for illuminating a selected receptacle associated with the number wherein a prize is in the receptacle awaiting presentation to the recipient. In one form, the electronic game includes a light beam emitting generator in the form of a triggered gun which the participant aims at a target. The target presents a sequence of random numbers which are responsive to the light beam for selecting a given number of the sequence which is then illuminated on a display board the sequence of numbers arranged in rows and columns. Simultaneously, the table having a plurality of receptacles is provided with illumination means around each of the respective receptacles that illuminates in response to selection of the given number from the sequence. A prize is situated or disposed in each of the respective receptacles so that upon illumination of a given receptacle corresponding to the selected number of the sequence will allow the participant to win that prize.

The electronic means for effecting simultaneous illumination as well as for selecting a number from the sequence is under the influence of an actuator circuit in the light beam generator as well as via a controller and a row and column selector coupled in parallel to a number display and a prize bin or table.

Therefore, it is among the primary objects of the present invention to provide a novel amusement game which will permit the selection of a number from a random sequence whereby the number is visually displayed on a panel and which is visually displayed on a prize bin so as to identify a bin containing a prize with the number obtained from the sequence.

Another object of the present invention is to provide an innovative amusement game using an electronic light beam generator aimed at a target for selecting a particular number from a sequence with that number associated with a numbered receptacle on a prize bin or table.

A further object of the present invention is to provide a novel game having a target with a continuous display of numbers in a random sequence that is responsive to the aim of a light beam from a beam generator such as a triggered gun which will automatically select a number from the sequence and this number is employed for identification of a particular receptacle on a prize bin.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
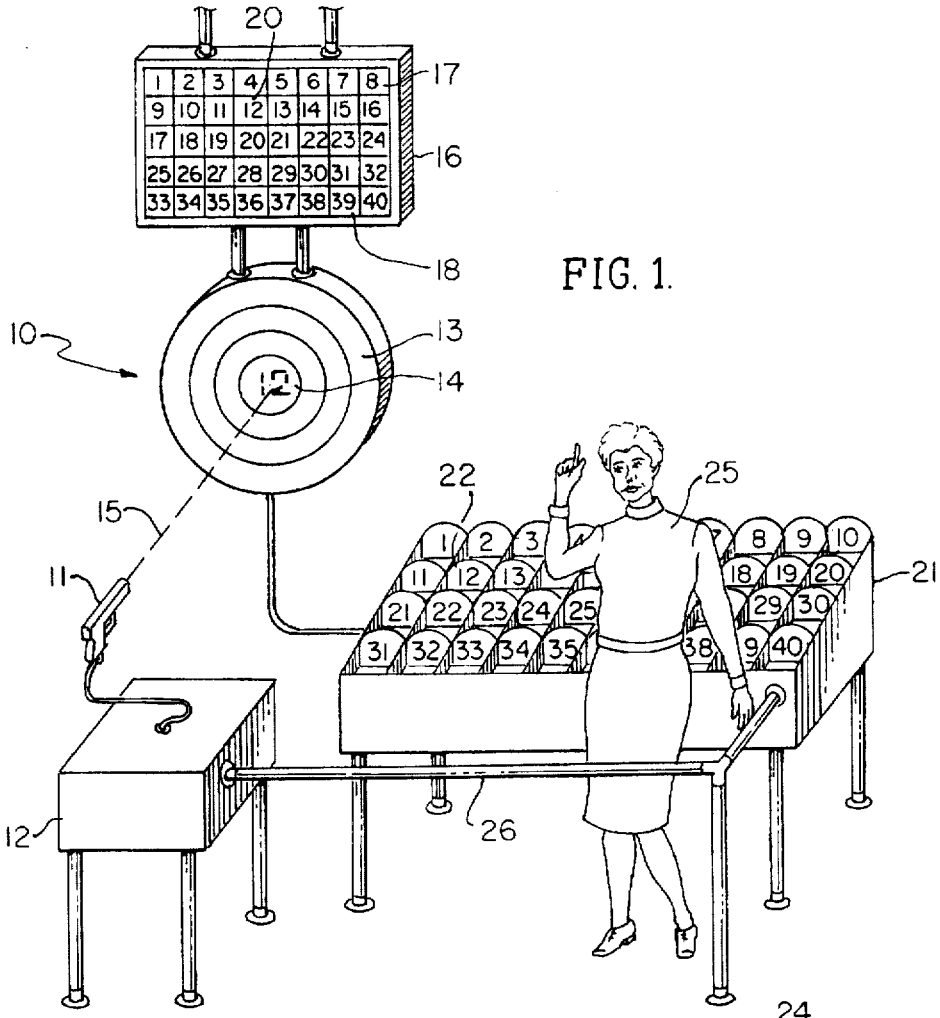
FIG. 1 is a front perspective view of the novel electronic game and amusement device incorporating the present invention.

Referring to FIG. 1, the novel electronic game of the present invention is illustrated in the general direction of arrow 10 and includes a light beam generator included within a hand-held implement such as a gun 11. The electronics for the system are included within a cabinet 12 and include such items as an actuator, controller, circuit selectors and power supply, which will be explained later. The electronic game 10 also includes a target 13 having a central area 14 which randomly displays a sequence of numbers serving as the target at which the participant points the light beam from the generator 11. The sequence of numbers is preferably displayed employing light-emitting diodes and the circuitry is responsive to the presence of the light beam, as indicated by numeral 15, to stop the sequence at a particular number. In the present instance, the number at which the sequence has been stopped is number 12.

A display board or panel 16 has a plurality of rows and columns, such as row 17 and column 18, wherein the sequence of numbers is visible upon illumination and the number 12 as a particular number selected from the sequence 14 is displayed and visually illuminated and is represented by numeral 20. Therefore, the number is displayed on the target 14 as well as illuminated on the display board 16.

A prize bin 21 is located in the game area and includes a plurality of receptacles, such as receptacle 22, that are open and which are occupied by prizes. Receptacle 22 is identified by the number 12 and lights surrounding the opening to the receptacle are illuminated in response to the selection of the number 12 in the target area 14. Simultaneous illumination of the number 12 on the board 16 as well as the illumination of receptacle 22 in bin 21 adds to the amusement and enjoyment of the game since the open receptacles display a variety of prizes and an audience as well as the participants can immediately identify the prize earned by the participant.

It is to be noted that the numbered receptacles are arranged in rows and columns in an identical array as compared to the rows and columns in the display board 16. Therefore, simultaneous illumination of a particular or given number will be consistent and visually noticeable whether the participant or audience is viewing the display panel 16 or the illuminated receptacles in the bin 21.

Figure 3:
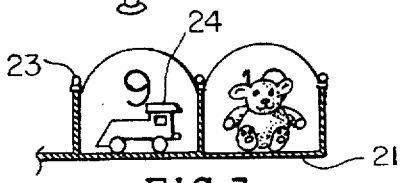
FIG. 3 is an enlarged fragmentary sectional view showing illuminated receptacles disposed on a prize bin used in the electronic game shown in FIGS. 1 and 2.

FIG. 3 illustrates illumination means, such as light-emitting diodes 23, surrounding the opening leading into a respective bin. A prize 24 is illustrated within the receptacle and should the number associated with this prize be selected from the sequence of numbers at the target 14, the participant would receive this prize. The prize can be manually withdrawn from the receptacle by a monitor 25 or, in some instances, the participant may be allowed to withdraw the prize. For control purposes, the monitor 25 may be permitted to stand or work ahead of the bin 21 and an audience would remain behind a guard bar 26, as shown in FIG. 1. The distance of space between the guard bar 26 and the front of bin 21 provides a work area for the monitor 25.

Figure 2:
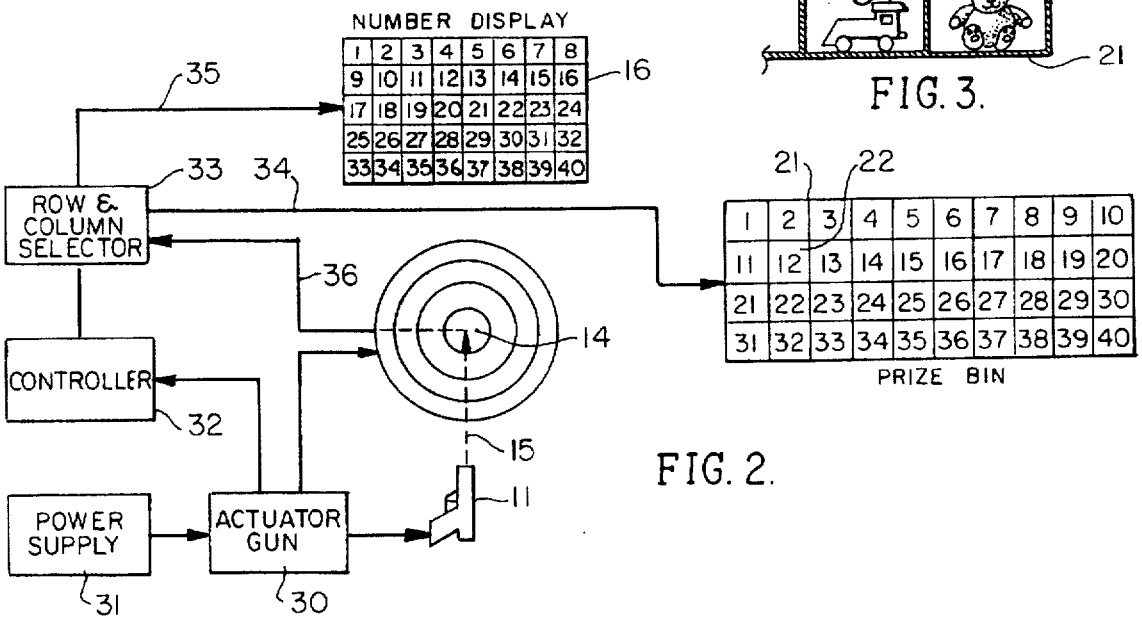
FIG. 2 is a schematic drawing of the game used in FIG. 1.

Referring now in detail to FIG. 2, it can be seen that the light beam generator 11 includes an actuator means 30 that includes conventional circuitry for generating the light beam 15 when the trigger of the gun 11 is moved. The actuator is connected to a power supply 31 which supplies full power for the system. Upon actuation, the circuit 30 sends a signal to a controller 32 and to a row and column selector 33. These are circuits which will ensure that the illumination of a particular number will be achieved in a row and column of the display panel 16 simultaneously with the illumination of a corresponding numbered receptacle on the bin 21. In addition to a signal from the controller 32 to actuate the illumination of a particular number on the display panel 16, the signal from the target 14 passes through the selector 32 and is introduced to the illumination circuit of the prize bin via lead 34. Lead 35 simultaneously carries the signal from the selector 33 to the display panel illumination means 16.

Of extreme importance is the connection of the light beam responsive circuit in the target 14 which sends the particular number selected information to the selector 33 via lead 36.

In view of the foregoing, it can be seen that the electronic game of the present invention provides a novel and amusing challenge and game for participants whereby an audience may view the proceedings. An audience and participant can stand behind the bar 26 while the monitor 25 works within the area between the bar 26 at the front of bin 21. The target 14 randomly displays the sequence of numbers which is then stopped by the light beam 15 when the center of the target 13 has been impacted by the light beam. Once the sequence is stopped, the selected or particular number is then simultaneously flashed onto the display board 16 in the proper row and column while the particular receptacle is illuminated in the bin 21. The monitor or the participant can then select the prize in the illuminated receptacle.

In an example of actual play, one to 40 players may participate in the game and 40 tokens are available to associated with each of the prizes. After an adequate number of players have indicated their participation, the dealer or monitor announces the start of the game. The dealer requests volunteers from the audience who wish to aim and shoot at the randomly moving numbers in the target. The random numbers are presented at the center of the target and are mixed with a speed of mixture at approximately 30 miles per hour. Simultaneously, the plurality of numbers on the display board above the target are flashing but not corresponding to the random target numbers. Once any of the players aims and shoots at the "lucky" number in the sequence, that particular number stops immediately. The number that is stopped in the center Of the target lights up in a selected one of the bin receptacles as well as in the box above the target in the proper row and column. This signals the same number receptacle so that the lights on the receptacle on the bin turn on to display or indicate the prize within the receptacle. The "lucky" number is meant to be the winning number and the player who has the same numbered token wins the corresponding prize. Each square with a number has a prize placed on it in the event a flat table is used with a plurality of squares serving as receptacles. Also, in this particular game, a person may place additional 10 squares and with different prizes to the number of squares illustrated and these particular numbers are called "bonus" numbers.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An electronic game comprising:

a hand-held light beam generator means for producing a linear light beam;

a target displaying a random sequence of numbers responsive to said light beam for selecting a particular number from said sequence;

a display means having said sequence of numbers arranged in rows and columns;

a prize bin having a plurality of open receptacles corresponding to said sequence of numbers arranged in rows and columns; and control means coupling said target to said display means and said prize bin for simultaneously displaying said particular number in said row and column and indicating said open receptacle corresponding to said particular number.

2. The invention as defined in claim 1 including:

a prize disposed in each of said open receptacles and being visually exposed to exterior view.

3. The invention as defined in claim 2 wherein:

said display panel and said prize bin having illumination means selectively responsive to said particular number selection to illuminate, attracting player attention.

4. The invention as defined in claim 3 wherein:

said light beam generator means is a hand-held gun with a trigger mechanism initiating said light beam generation.

5. The invention as defined in claim 4 including:

a railing in spaced-apart relationship with respect to said prize bin defining a work area occupied by a worker or monitor.

6. The invention as defined in claim 5 including:

means carried by said target having a lighted numerical random sequence of lighted numbers and sensor means operable to said light beam to stop said random sequence at said particular number.

* * * * *